US010754272B1

(12) United States Patent
Nonaka et al.

(10) Patent No.: US 10,754,272 B1
(45) Date of Patent: Aug. 25, 2020

(54) CHARGING DEVICE AND CLEANING MEMBER

(71) Applicant: FUJI XEROX Co., Ltd., Tokyo (JP)

(72) Inventors: Akihiro Nonaka, Kanagawa (JP); Fuyuki Kano, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/540,639

(22) Filed: Aug. 14, 2019

(30) Foreign Application Priority Data

Mar. 27, 2019 (JP) ..... 2019-059667

(51) Int. Cl.
*G03G 15/02* (2006.01)

(52) U.S. Cl.
CPC ..... *G03G 15/0225* (2013.01); *G03G 15/0233* (2013.01); *G03G 2215/021* (2013.01)

(58) Field of Classification Search
CPC ..... G03G 15/0225; G03G 15/0258; G03G 2215/021; G03G 15/0233
USPC ..... 399/100, 176
See application file for complete search history.

(56) References Cited

U.S. PATENT DOCUMENTS 3,999,510 A * 12/1976 Thettu ..... G03G 15/2025 399/327
5,678,134 A * 10/1997 Miki ..... G03G 15/161 15/1.51
6,263,176 B1 * 7/2001 An ..... G03G 15/161 399/101
9,411,254 B2 * 8/2016 Kawahara ..... G03G 15/0225
2008/0166154 A1 * 7/2008 Watanabe ..... G03G 15/0216 399/174
2009/0010674 A1 * 1/2009 Inoue ..... G03G 15/0225 399/100
2012/0082852 A1 * 4/2012 Nose ..... G03G 15/0233 428/411.1
2012/0301180 A1 * 11/2012 Tomomizu ..... C08G 77/58 399/111
2013/0149000 A1 * 6/2013 Sugino ..... G03G 15/2025 399/94
2015/0125183 A1 * 5/2015 Rokutan ..... G03G 15/0233 399/176

FOREIGN PATENT DOCUMENTS

JP 2015-152829 A 8/2015

* cited by examiner

*Primary Examiner* — Robert B Beatty
(74) *Attorney, Agent, or Firm* — Sughrue Mion, PLLC

(57) ABSTRACT

A charging device includes a charging member that includes a conductive elastic layer and a conductive surface layer disposed on an outer circumferential surface of the conductive elastic layer and a cleaning member that includes a support and a foamed elastic layer disposed on an outer circumferential surface of the support and having a higher surface free energy than the conductive surface layer of the charging member and that rotates in contact with the conductive surface layer of the charging member.

11 Claims, 5 Drawing Sheets

CHARGING DEVICE AND CLEANING MEMBER

CROSS-REFERENCE TO RELATED APPLICATIONS

This application is based on and claims priority under 35 USC 119 from Japanese Patent Application No. 2019-059667 filed Mar. 27, 2019.

BACKGROUND

(i) Technical Field

The present disclosure relates to charging devices, process cartridges, and image-forming apparatuses.

(ii) Related Art

Japanese Unexamined Patent Application Publication No. 2015-152829 discloses a charging device including a roller-shaped charging member and a roller-shaped cleaning member. The charging member includes a conductive support, a conductive elastic layer disposed on the outer circumferential surface of the conductive support, and a conductive surface layer disposed on the outer circumferential surface of the conductive elastic layer. The conductive surface layer has a surface free energy of 50 mN/m or more and 90 mN/m or less. The cleaning member includes a support and a foamed elastic layer disposed on the outer circumferential surface of the support. The foamed elastic layer contains 40 or more and 75 or less foam cells per 25 mm. The cleaning member rotates in contact with the conductive surface layer of the charging member.

SUMMARY

Aspects of non-limiting embodiments of the present disclosure relate to a charging device including a charging member and a cleaning member and having a reduced tendency to cause streak-like image defects as compared to a charging device in which a foamed elastic layer of a cleaning member has a lower surface free energy than a conductive surface layer of a charging member.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a charging device that includes a charging member including a conductive elastic layer and a conductive surface layer disposed on an outer circumferential surface of the conductive elastic layer and a cleaning member that includes a support and a foamed elastic layer disposed on an outer circumferential surface of the support and having a higher surface free energy than the conductive surface layer of the charging member and that rotates in contact with the conductive surface layer of the charging member.

BRIEF DESCRIPTION OF THE DRAWINGS

An exemplary embodiment of the present disclosure will be described in detail based on the following figures, wherein.

DETAILED DESCRIPTION

Figure 1:
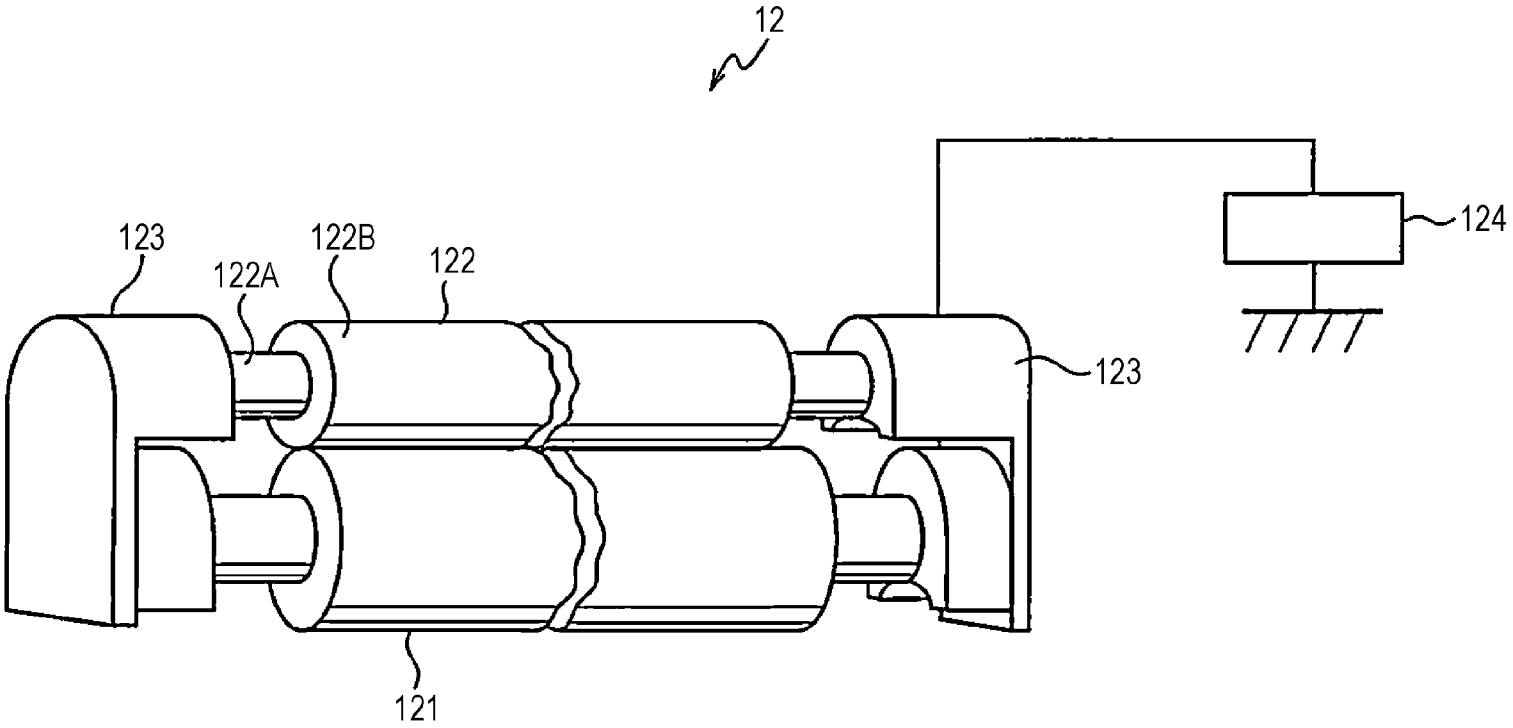
FIG. 1 is a schematic perspective view of a charging device according to the exemplary embodiment.

An exemplary embodiment of the present disclosure will hereinafter be described.

A charging device according to the exemplary embodiment comprises a charging member and a cleaning member that rotates in contact with a conductive surface layer of the charging member.

The charging member includes a conductive elastic layer and the conductive surface layer, which is disposed on the outer circumferential surface of the conductive elastic layer.

The cleaning member, on the other hand, includes a support and a foamed elastic layer disposed on the outer circumferential surface of the support and having a higher surface free energy than the conductive surface layer of the charging member.

The foregoing configuration of the charging device according to the exemplary embodiment may reduce its tendency to cause streak-like image defects.

One possible explanation is given below.

A charging member in the related art includes a conductive surface layer for reducing surface contamination and the leaching of components contained in the conductive elastic layer (hereinafter "bleed").

However, oil components (e.g., silicone-containing oil and fluorine-containing oil) derived externally (e.g., from a counter member or other part) may adhere to the surface of the charging member. The adhesion and accumulation of an increasing amount of oil component on the surface of the charging member may cause streak-like image defects.

Accordingly, a cleaning member including a foamed elastic layer having a higher surface free energy than a conductive surface layer of a charging member may be used as a cleaning member for cleaning the surface of the charging member. This may facilitate transfer of oil components from the surface of the charging member to the surface of the cleaning member (i.e., to the surface of the foamed elastic layer).

Thus, the adhesion and accumulation of oil components on the surface of the charging member may be reduced.

As can be seen from the foregoing, the charging device according to the exemplary embodiment may have a reduced tendency to cause streak-like image defects.

The charging device according to the exemplary embodiment will hereinafter be described with reference to the drawings. It should be noted that components having substantially the same functions are indicated by the same reference numerals throughout the drawings, and a description thereof may be omitted.

As shown in FIG. 1, a charging device 12 according to the exemplary embodiment includes, for example, a charging member 121 and a cleaning member 122 that are disposed in contact with each other at a particular depth of depression. A conductive support (30 in FIGS. 2 and 3) of the charging member 121 and a support 122A of the cleaning member 122 are supported at both ends in the axial direction by conductive bearings 123 (e.g., conductive rolling bearings) so that each member is rotatable. A power supply 124 is connected to one of the conductive bearings 123.

The individual components of the charging device 12 will hereinafter be described in detail.

Charging Member

The charging member 121 will hereinafter be described with reference to FIGS. 2 and 3.

Figure 2:
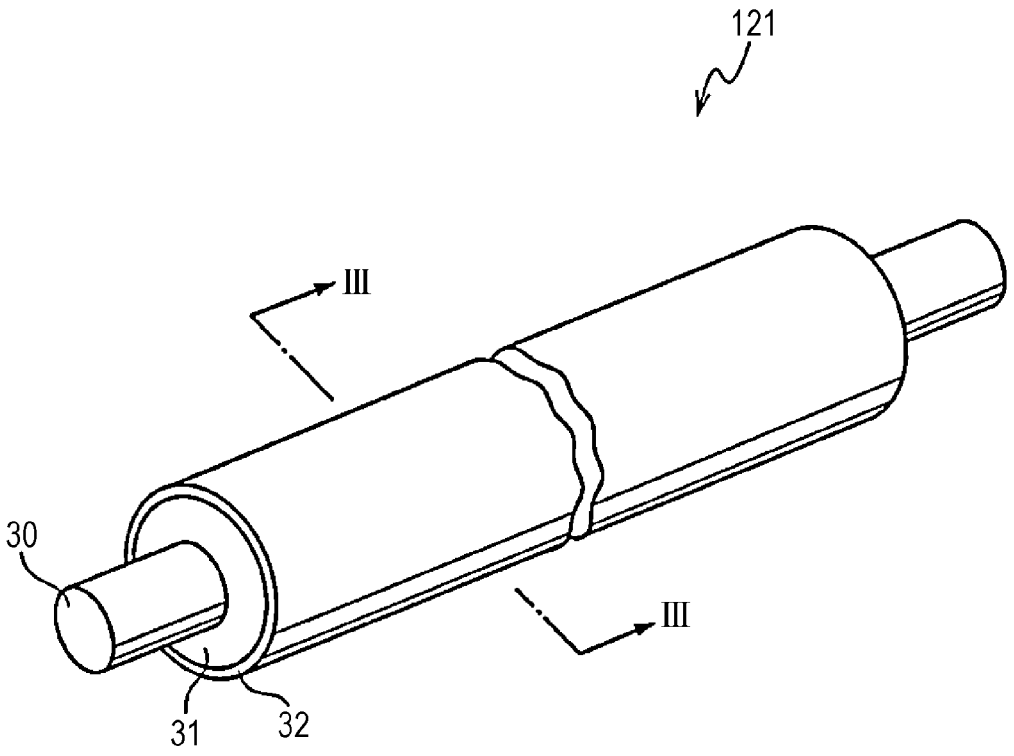
FIG. 2 is a schematic perspective view of a charging member according to the exemplary embodiment.

FIG. 2 is a schematic perspective view of the charging member according to the exemplary embodiment. FIG. 3 is a schematic sectional view of the charging member according to the exemplary embodiment. FIG. 3 is a sectional view taken along line III-III of FIG. 2.

Figure 3:
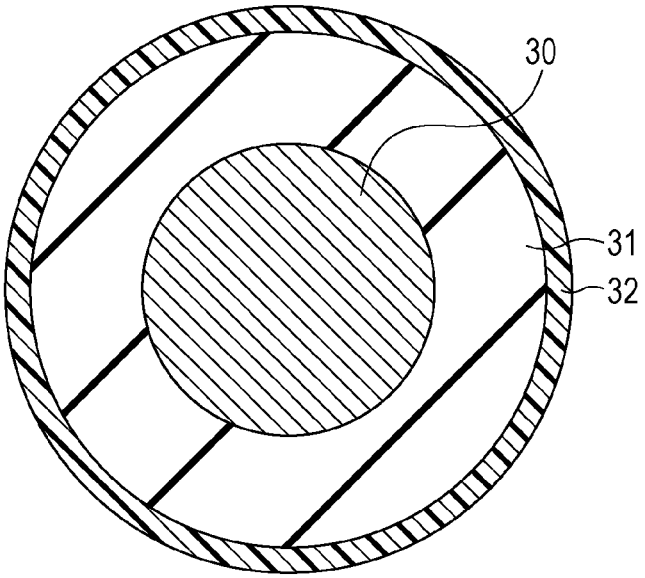
FIG. 3 is a schematic sectional view of the charging member according to the exemplary embodiment (i.e., a sectional view taken along line III-III of FIG. 2)

As shown in FIGS. 2 and 3, the charging member 121 is, for example, a roller member including a conductive support 30 (hereinafter referred to as "support 30"), a conductive elastic layer 31 disposed on the outer circumferential surface of the conductive support 30 (hereinafter referred to as "elastic layer 31"), and a conductive surface layer 32 disposed on the outer circumferential surface of the conductive elastic layer 31 (hereinafter referred to as "surface layer 32"). For example, an adhesive layer (not shown) is disposed between the support 30 and the elastic layer 31.

The charging member 121 is not limited to the foregoing layer configuration, but may instead have a configuration in which an intermediate layer is disposed between the support 30 and the elastic layer 31 or a configuration in which a resistance adjustment layer or a transfer blocking layer is disposed between the elastic layer 31 and the surface layer 32.

The charging member 121 is not limited to a roller member, but may instead be, for example, a belt member.

As used herein, the term "conductive" refers to a volume resistivity of less than $1\times10^{13}$ Ωcm at 20° C.

The charging member 121 will hereinafter be described in detail. It should be noted that reference numerals are omitted in the description below.

Support

The support functions as an electrode and support member for the charging member. Examples of materials that may be used for the support include metals and alloys such as iron (e.g., free-cutting steel), copper, brass, stainless steel, aluminum, and nickel; and iron coated with metals such as chromium and nickel. Other examples of supports include members (e.g., resin and ceramic members) having the outer circumferential surfaces thereof coated with metals and members (e.g., resin and ceramic members) having conductors dispersed therein. The support may be a hollow member (i.e., a tubular member) or a non-hollow member.

Adhesive Layer

Examples of materials that may be used for the adhesive layer include known adhesives that are conductive compositions capable of bonding the support and the elastic layer together. Examples of such adhesives include resin compositions containing electronic conductors and resin compositions containing conductive resins.

Elastic Layer

The elastic layer contains an elastic material and a conductor. The elastic layer may optionally contain other additives. The elastic layer may function as a resistance adjustment layer.

Examples of elastic materials include isoprene rubber, chloroprene rubber, epichlorohydrin rubber, butyl rubber, urethane rubber, silicone rubber, fluorocarbon rubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene copolymer rubber, acrylonitrile-butadiene copolymer rubber, natural rubber, and mixtures thereof.

Preferred of these elastic materials are silicone rubber, ethylene-propylene rubber, epichlorohydrin-ethylene oxide copolymer rubber, epichlorohydrin-ethylene oxide-allyl glycidyl ether copolymer rubber, and mixtures thereof.

The rubber material may be foamed or unfoamed.

Examples of conductors include electronically conductive materials and ionically conductive materials.

Examples of electronically conductive materials include carbon black such as Ketjen black and acetylene black; pyrolytic carbon; graphite; metals such as zinc, aluminum, copper, iron, nickel, chromium, and titanium; and known metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TIO_2$, $SnO_2$, $Sb_2O_3$, $In_2O_3$, ZnO, and MgO.

Examples of ionically conductive materials include known salts such as quaternary ammonium salts, alkali metal perchlorates, and alkaline earth metal perchlorates.

These conductors may be used alone or in a combination of two or more thereof.

The conductor may be present in any amount as long as the intended properties of the elastic layer are achieved.

Specifically, if the conductor is an electronically conductive material, it may be present in an amount of 1 part by mass or more and 90 parts by mass or less per 100 parts by mass of the elastic material.

On the other hand, if the conductor is an ionically conductive material, it may be present in an amount of 0.01 parts by mass or more and 10 parts by mass or less per 100 parts by mass of the elastic material.

Examples of other additives that may be used for the elastic layer include known additives such as softeners, plasticizers, vulcanizing agents, vulcanization accelerators, antioxidants, surfactants, and coupling agents.

If the elastic layer functions as, for example, a resistance adjustment layer, it may have a volume resistivity of, for example, $10^3$ Ωcm or more and $10^{14}$ Ωcm or less, preferably $10^5$ Ωcm or more and $10^{12}$ Ωcm or less, more preferably $10^7$ Ωcm or more and $10^{12}$ Ωcm or less.

The volume resistivity of the elastic layer is measured by the method presented below.

Specifically, a sheet-shaped test specimen is removed from the elastic layer. A voltage is applied to the test specimen for 30 seconds in accordance with JIS K 6911 (1995) using a test jig (R12702A/B resistivity chamber available from Advantest Corporation) and a high-resistance meter (R8340A digital high-resistance/extremely-low-current meter available from Advantest Corporation). The applied voltage is adjusted so that the electric field (applied voltage/composition sheet thickness) is 1,000 V/cm. The volume resistivity is calculated from the current flowing through the test specimen using the following equation:

$$\text{Volume resistivity } (\Omega\text{cm}) = (19.63 \times \text{applied voltage } (V))/(\text{current } (A) \times \text{test specimen thickness } (cm))$$

The thickness of the elastic layer varies depending on the apparatus to which the charging member is applied. For example, the elastic layer may have a thickness of 1 mm or more and 10 mm or less, preferably 2 mm or more and 5 mm or less.

The thickness of the elastic layer is measured by the method presented below.

Specifically, specimens are cut using a single-edged knife from the elastic layer at three positions, namely, at positions 20 mm from both ends and in the center of the elastic layer (charging member) in the axial direction. The thicknesses of the cut specimens are measured by observing the cross-sections thereof at a suitable magnification in the range from 5× to 50×, depending on the thickness, and the average thereof is calculated. A VHX-200 digital microscope available from Keyence Corporation is used for the measurement.

Surface Layer

The surface layer has a lower surface free energy than the surface of the cleaning member (specifically, the foamed elastic layer of the cleaning member). This may reduce the adhesion and accumulation of oil components on the charging member and may thus reduce the tendency to cause streak-like image defects.

To reduce the adhesion and accumulation of oil components on the charging member, the surface layer preferably has a surface free energy of 90 mN/m or more (or more than 90 mN/m) and 150 mN/m or less, more preferably 100 mN/m or more and 140 mN/m or less, even more preferably 110 mN/m or more and 130 mN/m or less.

The surface free energy is measured by the method presented below.

The contact angles of reagents with known dipole components, dispersion components, and hydrogen bonding components of surface free energy, namely, pure water, methylene iodide, α-bromonaphthalene, and ethylene glycol, on the surface of the layer under measurement are measured using a CA-X contact angle meter (trade name, available from Kyowa Interface Science, Inc.) in a normal temperature and humidity (22° C. and 55% RH) environment. The surface free energy is calculated from the measurement results based on Fowkes equation using the surface free energy analysis software EG-11 (trade name, available from Kyowa Interface Science, Inc.). The drop volume of each reagent is 2.5 μL, and the contact angle is measured 60 seconds after the reagent is dropped.

One example method for adjusting the surface free energy of the surface layer within the above range is to adjust the surface roughness Rz of the surface layer.

Specifically, the surface layer preferably has a surface roughness Rz of 15 μm or more and 30 μm or less, more preferably 17 μm or more and 28 μm or less, even more preferably 20 μm or more and 25 μm or less.

The surface roughness Rz is the ten-point average roughness Rz measured by the method presented below.

The surface roughness Rz is measured in accordance with JIS B 0601(1994) at three positions, namely, at positions 20 mm from both ends and in the center of the layer under measurement in the axial direction of the charging member, and the average thereof is calculated. A SURFCOM 1400 available from Tokyo Seimitsu Co., Ltd. is used for the measurement. The measurement conditions are as follows: cutoff=0.8 mm, length of measurement=2.4 mm, and traverse speed=0.3 mm/sec.

Example methods for adjusting the surface roughness Rz of the surface layer within the above range include adjusting the polishing conditions for the underlying elastic layer and adjusting the filler content of the surface layer.

The surface layer may be a resin layer provided independently of the elastic layer or may be formed by impregnating bubbles in a surface portion of a foamed elastic layer with a resin or other material (that is, the surface layer may be a surface portion of the elastic layer in which bubbles are impregnated with a resin or other material).

Examples of materials that may be used to form the surface layer include resins.

Examples of resins include acrylic resins, fluorine-modified acrylic resins, silicone-modified acrylic resins, cellulose resins, polyamide resins, nylon copolymers, polyurethane resins, polycarbonate resins, polyester resins, polyimide resins, epoxy resins, silicone resins, polyvinyl alcohol resins, polyvinyl butyral resins, polyvinyl acetal resins, ethylene-tetrafluoroethylene resins, melamine resins, polyethylene resins, polyvinyl resins, polyarylate resins, polythiophene resins, polyethylene terephthalate resins (PET), and fluorocarbon resins (e.g., polyvinylidene fluoride resins, tetrafluoroethylene resins, tetrafluoroethylene-perfluoro(alkyl vinyl ether) copolymers (PFA), and tetrafluoroethylene-hexafluoropropylene copolymers (FEP)). Curable resins may be cured or crosslinked with curing agents or catalysts.

Nylon copolymers are copolymers containing one or more polymerized units selected from the group consisting of nylon 6,10, nylon 11, and nylon 12. Nylon copolymers may also contain other polymerized units such as nylon 6 and nylon 66.

Of these, polyvinylidene fluoride resins, tetrafluoroethylene resins, and polyamide resins are preferred as resins to prevent soiling, and polyamide resins are more preferred to improve the wear resistance of the surface layer and to reduce the susceptibility of porous resin particles to come off.

In particular, alkoxymethylated polyamides (alkoxymethylated nylons) are preferred as polyamide resins to improve the wear resistance of the surface layer, and methoxymethylated polyamide (N-methoxymethylated nylon) is more preferred.

To improve the mechanical strength of the surface layer and to reduce the susceptibility of the surface layer to crack, the resin may have a crosslinked structure.

If the resin has a crosslinked structure, the surface layer preferably has a gel fraction of 50% or more and 100% or less, more preferably 60% or more and 100% or less.

The gel fraction is measured in accordance with JIS K6796(1998).

Specifically, a test specimen is removed from the surface layer. The mass of the removed test specimen is measured and used as the mass before solvent extraction. The test specimen is then immersed in the solvent used for the preparation of the coating solution for forming the surface layer for 24 hours. The solvent is removed by filtration, and the residue is weighed. This weight is used as the mass after extraction. The gel fraction is calculated using the following equation:

$$\text{gel fraction}=100\times(\text{mass after solvent extraction})/(\text{mass before solvent extraction}) \quad \text{Equation:}$$

Examples of other materials that may be used to form the surface layer include known additives that can typically be added to surface layers, such as conductors, fillers, curing agents, vulcanizing agents, vulcanization accelerators, antioxidants, surfactants, and coupling agents.

The surface layer may have a volume resistivity of, for example, $10^3$ Ωcm or more and $10^{14}$ Ωcm or less, preferably $10^5$ Ωcm or more and $10^{12}$ Ωcm or less, more preferably $10^7$ Ωcm or more and $10^{12}$ Ωcm or less.

The volume resistivity of the surface layer is measured by the method presented below.

Specifically, the surface layer is applied to a plate of a metal such as aluminum or stainless steel or to a sheet of a rubber or other material with a volume resistivity of 10 Ωcm or less to obtain a test specimen. A voltage is then applied to the test specimen for 30 seconds in accordance with JIS K 6911(1995) using a test jig (R12702A/B resistivity chamber available from Advantest Corporation) and a high-resistance meter (R8340A digital high-resistance/extremely-low-current meter available from Advantest Corporation). The applied voltage is adjusted so that the electric field (applied voltage/composition sheet thickness) is 1,000 V/cm. The volume resistivity is calculated from the current flowing through the test specimen using the following equation:

Volume resistivity (Ωcm)=(19.63×applied voltage (V))/(current (A)×test specimen thickness (cm))

To prevent contamination and cracking, the surface layer may have a dynamic ultra micro hardness of, for example, 0.04 or more and 0.5 or less, preferably 0.08 or more and 0.3 or less.

The dynamic ultra micro hardness (hereinafter also referred to as "DH") of the surface layer is the hardness calculated using the following equation:

$$DH=+\times P/D^2 \quad \text{Equation:}$$

where α is a constant depending on the shape of the indenter, P (mN) is the test load at which the indenter is pressed into the specimen at a constant indentation rate (mN/s), and D (μm) is the depth of indentation.

The dynamic ultra micro hardness is measured using a DUH-W201S dynamic ultra micro hardness tester (available from Shimadzu Corporation). The dynamic ultra micro hardness can be determined from the depth of indentation D measured by a soft material measurement in which a triangular pyramidal indenter (apex angle=115°, α=3.8584) is pressed into the surface layer of the charging member at an indentation rate of 0.14 mN/s and a test load of 1.0 mN.

To inhibit the movement of components bleeding from the elastic layer (i.e., liquid bleeding therefrom) and components blooming from the elastic layer (i.e., solid precipitating therefrom) to the surface of the charging member and to improve the resistance stability of the surface layer, the surface layer may have a thickness of, for example, 2 μm or more and 25 μm or less, preferably 3 μm or more and 20 μm or less, more preferably 3 μm or more and 15 μm or less, even more preferably 5 μm or more and 15 μm or less.

The thickness of the surface layer is measured by the method presented below.

Specifically, specimens are cut using a single-edged knife from the surface layer at three positions, namely, at positions 20 mm from both ends and in the center of the surface layer (charging member) in the axial direction. The thicknesses of the cut specimens are measured by observing the cross-sections thereof at a magnification of 1000×, and the average thereof is calculated. A VHX-200 digital microscope available from Keyence Corporation is used for the measurement.

The surface layer is formed, for example, by dispersing various ingredients in a solvent to prepare a coating solution, applying the coating solution to an elastic layer formed in advance, and heating the coating.

Examples of processes that may be used to apply the coating solution include blade coating processes, wire bar coating processes, spray coating processes, dip coating processes, bead coating processes, air knife coating processes, curtain coating processes, flow coating processes, ring coating processes, die coating processes, and inkjet coating processes.

The solvent used for the coating solution may be any commonly used solvent. Examples of solvents that may be used include alcohols such as methanol, ethanol, propanol, and butanol; ketones such as acetone and methyl ethyl ketone; and ethers such as tetrahydrofuran, diethyl ether, and dioxane. Although various other solvents may also be used, alcohol solvents, ketone solvents, and mixtures thereof may be used for dip coating processes.

Cleaning Member

As shown in FIG. 1, the cleaning member 122 is, for example, a roller member including a conductive support 122A (hereinafter referred to as "support 122A") and a foamed elastic layer 122B disposed on the outer circumferential surface of the conductive support 122A (hereinafter referred to as "foamed elastic layer 122B").

The cleaning member 122 according to the exemplary embodiment will hereinafter be described in detail. It should be noted that reference numerals are omitted in the description below.

Support

The support is a solid or hollow cylindrical conductive member. Examples of materials that may be used for the support include metals such as iron (e.g., free-cutting steel), copper, brass, stainless steel, aluminum, and nickel.

Other examples of supports include members (e.g., resin and ceramic members) having the outer circumferential surfaces thereof coated with metals and members (e.g., resin and ceramic members) having conductors dispersed therein.

Foamed Elastic Layer

The foamed elastic layer is, for example, an elastic layer formed of a foam having a three-dimensional porous structure with inner cavities and surface irregularities (hereinafter referred to as "foam cells").

The foamed elastic layer has a higher surface free energy than the surface of the charging member (i.e., the conductive surface layer). This may reduce the adhesion and accumulation of oil components on the charging member and may thus reduce the tendency to cause streak-like image defects.

To reduce the adhesion and accumulation of oil components on the charging member, the foamed elastic layer preferably has a surface free energy of more than 150 mN/m and 210 mN/m or less, more preferably 160 mN/m or more and 200 mN/m or less, even more preferably 170 mN/m or more and 190 mN/m or less.

The surface free energy is measured by the method described above.

One example method for adjusting the surface free energy of the foamed elastic layer within the above range is to adjust the cell size of the foamed elastic layer.

Specifically, the foamed elastic layer preferably has an average cell size of 100 μm or more and 200 μm or less, more preferably 120 μm or more and 180 μm or less, even more preferably 140 μm or more and 160 μm or less.

The average cell size is determined in accordance with Appendix 1 of JIS K 6400-1(2004) by measuring the number of cells over a length of 25 mm and calculating the average cell size using the following equation:

Average cell size=25 mm/number of cells

Another example method for adjusting the surface free energy of the foamed elastic layer within the above range is to adjust the surface roughness Rz of the foamed elastic layer.

Specifically, the foamed elastic layer preferably has a surface roughness Rz of 80 μm or more and 180 μm or less, more preferably 100 μm or more and 160 μm or less, even more preferably 120 μm or more and 140 μm or less.

The surface roughness Rz is the ten-point average roughness Rz measured by the method presented below.

The surface roughness Rz is measured in accordance with JIS B 0601(1994) at three positions, namely, at positions 20 mm from both ends and in the center of the layer under measurement in the axial direction of the cleaning member, and the average thereof is calculated. A SURFCOM 1400 available from Tokyo Seimitsu Co., Ltd. is used for the measurement. The measurement conditions are as follows: cutoff=0.8 mm, length of measurement=2.4 mm, and traverse speed=0.3 mm/sec.

One example method for adjusting the surface roughness Rz of the foamed elastic layer within the above range is to select a foam with a different expansion ratio.

To reduce the adhesion and accumulation of oil components on the charging member, the foamed elastic layer preferably contains 80 or more and 120 or less foam cells, more preferably 90 or more and 110 or less foam cells, per 25 mm.

The term "number of foam cells" refers to the number of cells described in JIS K 6400-1(2004). The number of foam cells is measured by the method described in Appendix 1 of JIS K 6400-1(2004).

The foamed elastic layer is formed from a foamable resin or rubber material such as polyurethane, polyethylene, polyamide, polyolefin, melamine resin, polypropylene, acrylonitrile-butadiene copolymer rubber (NBR), ethylene-propylene-diene copolymer rubber (EPDM), natural rubber, styrene-butadiene rubber, chloroprene rubber, silicone rubber, or nitrile rubber.

Of these foamable resin and rubber materials, polyurethane is particularly suitable for efficiently removing foreign matter such as toner and external additive by sliding contact with the charging member, thereby reducing the tendency to cause streak-like image defects, while leaving less scratches on the surface of the charging member due to rubbing with the cleaning member, and for improving the resistance to tear and other damage over a long period of time.

Examples of polyurethanes include, but not limited to, reaction products of polyols (e.g., polyester polyols, polyether polyols, and acrylic polyols) with isocyanates (e.g., 2,4-tolylene diisocyanate, 2,6-tolylene diisocyanate, 4,4-diphenylmethane diisocyanate, tolidine diisocyanate, and 1,6-hexamethylene diisocyanate) and those reacted with chain extenders (e.g., 1,4-butanediol and trimethylolpropane).

In addition to the foamable resin or rubber material, additives such as blowing agents and foam stabilizers may optionally be used to form the foamed elastic layer. In particular, polyurethanes are typically foamed using additives such as blowing agents and foam stabilizers.

Examples of blowing agents that may be used include known blowing agents such as water, azo compounds (e.g., azodicarbonamide and azobisisobutyronitrile).

Examples of foam stabilizers that may be used include known foam stabilizers such as silicone foam stabilizers (e.g., straight silicones such as dimethyl silicone oil, methyl hydrogen silicone oil, diphenyl silicone oil, methyl phenyl silicone oil, and chlorophenyl silicone oil; and modified silicone oils such as alkyl-modified silicone oils, aralkyl-modified silicone oils, polyether-modified silicone oils, polyester-modified silicone oils, fluoroalkyl-modified silicone oils, amino-modified silicone oils, alkoxy-modified silicone oils, epoxy-modified silicone oils, and carboxyl-modified silicone oils).

The foamed elastic layer may be a tubular foamed elastic member formed around the entire outer circumferential surface of the support or may be a strip-shaped foamed elastic member wound spirally around the outer circumferential surface of the support.

The foamed elastic layer may be formed, for example, by applying a mixture of the ingredients that form the foamed elastic layer with the ingredients that contribute to foaming, such as blowing agents and foam stabilizers, to the outer circumferential surface of the support and then shaping and foaming the mixture. Alternatively, the foamed elastic layer may be formed by bonding a foam having a through-hole formed therein in advance to the outer circumferential surface of the support with an adhesive and then polishing the outer surface thereof.

The cleaning member may have a larger outer diameter than the charging member. Specifically, the ratio of the outer diameter of the charging member to the outer diameter of the cleaning member (outer diameter of charging member/outer diameter of cleaning member) is preferably 8/12 or more and 14/6 or less, more preferably 10/12 or more and 12/6 or less, even more preferably 10/10 or more and 12/8 or less.

If the cleaning member has a larger outer diameter than the charging member, the surface of the cleaning member may retain a larger amount of oil component. This may reduce the adhesion and accumulation of oil components on the charging member and may thus reduce the tendency to cause streak-like image defects over a longer period of time.

Conductive Bearings and Power Supply

The conductive bearings 123 and the power supply 124 of the charging device 12 will now be described.

The conductive bearings 123 are members that hold together the charging member 121 and the cleaning member 122 so that they are rotatable and that maintain the shaft-to-shaft distance therebetween.

The shaft-to-shaft distance is adjusted to control the depth of depression of the charging member 121 and the cleaning member 122.

The conductive bearings 123 may be formed from any material in any form as long as they are manufactured from a conductive material. For example, conductive rolling bearings and conductive plain bearings are applicable.

The power supply 124 is a device that applies a voltage to the conductive bearings 123 to charge the charging member 121 and the cleaning member 122 to the same polarity. Known high-voltage power supply devices may be used.

Assembly

An assembly according to the exemplary embodiment includes a member to be cleaned and a cleaning member that rotates in contact with a surface of the member to be cleaned. The cleaning member includes a support and a foamed elastic layer disposed on the outer circumferential surface of the support and having a higher surface free energy than the surface of the member to be cleaned.

The assembly according to the exemplary embodiment has the same configuration as the charging device according to the exemplary embodiment except that the assembly includes, as the member to be cleaned, a member such as a charging member, a transfer member (e.g., a first transfer member, a second transfer member, or an intermediate transfer member), or a transport member.

That is, the surface (specifically, the layer forming the surface) of the member to be cleaned of the assembly according to the exemplary embodiment has a lower surface free energy than the foamed elastic layer of the cleaning member. Specifically, the surface of the member to be cleaned (specifically, the layer forming the surface of the member to be cleaned) preferably has a surface free energy of 90 mN/m or more (or more than 90 mN/m) and 150 mN/m or less, more preferably 100 mN/m or more and 140 mN/m or less, even more preferably 110 mN/m or more and 130 mN/m or less.

Thus, the adhesion and accumulation of oil components on the member to be cleaned of the assembly according to the exemplary embodiment may be reduced.

Image-Forming Apparatus and Process Cartridge

An image-forming apparatus according to the exemplary embodiment comprises an image carrier, a charging device that charges the image carrier, a latent-image forming device that forms a latent image on a charged surface of the image carrier, a developing device that develops the latent image formed on the surface of the image carrier with a toner to form a toner image, and a transfer device that transfers the toner image formed on the surface of the image carrier to a recording medium. The charging device comprises the charging device according to the exemplary embodiment.

A process cartridge according to the exemplary embodiment is attachable to and detachable from, for example, an image-forming apparatus having the foregoing configuration. The process cartridge according to the exemplary embodiment comprises an image carrier and a charging device that charges the image carrier. The charging device comprises the charging device according to the exemplary embodiment.

The process cartridge according to the exemplary embodiment may optionally include at least one device selected from the group consisting of a developing device that develops a latent image formed on a surface of the image carrier with a toner to form a toner image, a transfer device that transfers the toner image formed on the surface of the image carrier to a recording medium, and a cleaning device that removes residual toner from the surface of the image carrier after transfer.

The image-forming apparatus or the process cartridge according to the exemplary embodiment may include the assembly according to the exemplary embodiment.

Next, the image-forming apparatus and the process cartridge according to the exemplary embodiment will be described with reference to FIGS. 4 and 5.

Figure 4:
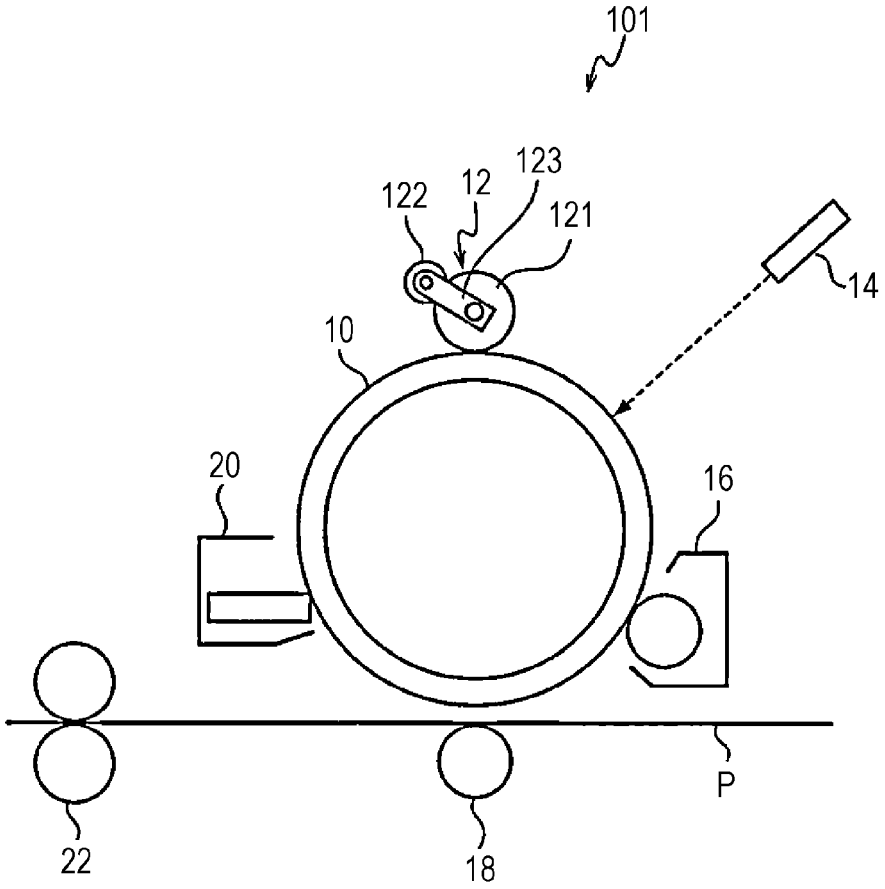
FIG. 4 is a schematic illustration of an image-forming apparatus according to the exemplary embodiment.

FIG. 4 is a schematic illustration of the image-forming apparatus according to the exemplary embodiment. FIG. 5 is a schematic illustration of the process cartridge according to the exemplary embodiment.

As shown in FIG. 4, an image-forming apparatus 101 according to the exemplary embodiment includes an image carrier 10 and, around the image carrier 10, a charging device 12 that charges the image carrier 10, an exposure device (latent-image forming device) 14 that exposes the image carrier 10 charged by the charging device 12 to form a latent image, a developing device 16 that develops the latent image formed by the exposure device 14 with a toner to form a toner image, a transfer device 18 that transfers the toner image formed by the developing device 16 to a recording medium P, and a cleaning device 20 that removes residual toner from the surface of the image carrier 10 after transfer. The image-forming apparatus 101 according to the exemplary embodiment also includes a fixing device 22 that fixes the toner image transferred to the recording medium P by the transfer device 18.

The image-forming apparatus 101 according to the exemplary embodiment includes, as the charging device 12, for example, the charging device according to the exemplary embodiment. The charging device according to the exemplary embodiment includes, for example, a charging member 121, a cleaning member 122 disposed in contact with the charging member 121, conductive bearings 123 (e.g., conductive rolling bearings) supporting the charging member 121 and the cleaning member 122 at both ends in the axial direction so that each member is rotatable, and a power supply 124 connected to one of the conductive bearings 123.

As the components other than the charging device 12 (i.e., the charging member 121 and the cleaning member 122), components known for use in electrophotographic image-forming apparatuses in the related art may be used for the image-forming apparatus 101 according to the exemplary embodiment. Examples of the individual components will hereinafter be described.

The image carrier 10 may be any known photoreceptor. For example, the image carrier 10 may be an organic photoreceptor having a so-called separated-function structure in which a photosensitive layer is divided into a charge generation layer and a charge transport layer.

The surface of the image carrier 10 may be covered by a protective layer having charge transport properties and having a crosslinked structure. The protective layer may contain a crosslinked component such as a siloxane-based resin, a phenol-based resin, a melamine resin, a guanamine resin, or an acrylic resin.

The layer present in the surface of the image carrier 10 (e.g., the charge transport layer or the protective layer) may contain a silicone oil as a leveling agent.

To reduce the effect of bleed from the charging member 121, as described above, the silicone oil used may have the same modifying moiety (substituent involved in modification) as the silicone oil present in the foamed elastic layer of the charging member 121. Specifically, these two silicone oils may be polyester-modified or polyether-modified.

The exposure device 14 may be, for example, a laser optical system or a light-emitting diode (LED) array.

The developing device 16 is, for example, a developing device in which a developer layer is formed on the surface of a developer carrier disposed in contact with or adjacent to the image carrier 10, and a toner is attracted to a latent image on the surface of the image carrier 10 to form a toner image. The developing device 16 may have a known developing system such as one that uses a two-component developer. Examples of developing systems that use two-component developers include cascade systems and magnetic brush systems.

The transfer device 18 may be, for example, a non-contact transfer system such as a corotron or a contact transfer system in which the recording medium P is transported between a conductive transfer roller and the image carrier 10 to transfer the toner image to the recording medium P.

The cleaning device 20 may include, for example, a cleaning blade disposed in direct contact with the surface of the image carrier 10 to remove materials such as toner, paper dust, and debris from the surface of the image carrier 10. Instead of the cleaning blade, the cleaning device 20 may include, for example, a cleaning brush or cleaning roller.

The fixing device 22 may be a heat fixing device that uses a heat roller. The heat fixing device includes, for example, a fixing roller and a pressing roller or pressing belt. The fixing roller includes a cylindrical core having a heater lamp for heating disposed therein and a heat-resistant resin coating layer or heat-resistant rubber coating layer, serving as a so-called release layer, formed on the outer circumferential surface of the cylindrical core. The pressing roller or pressing belt is disposed in contact with the fixing roller at a particular contact pressure and includes a cylindrical core or belt-shaped substrate and a heat-resistant elastomer layer formed on the outer circumferential surface of the cylindrical core or the surface of the belt-shaped substrate. An example process of fixing an unfixed toner image includes transporting a recording medium P having an unfixed toner image transferred thereto between the fixing roller and the pressing roller or pressing belt while melting toner components such as a binder resin and additives with heat to fix the toner image.

The image-forming apparatus 101 according to the exemplary embodiment is not limited to the foregoing configuration, but may instead be, for example, an intermediate-transfer image-forming apparatus that uses an intermediate transfer member or a so-called tandem image-forming apparatus including a parallel arrangement of image-forming units that form toner images of individual colors.

Figure 5:
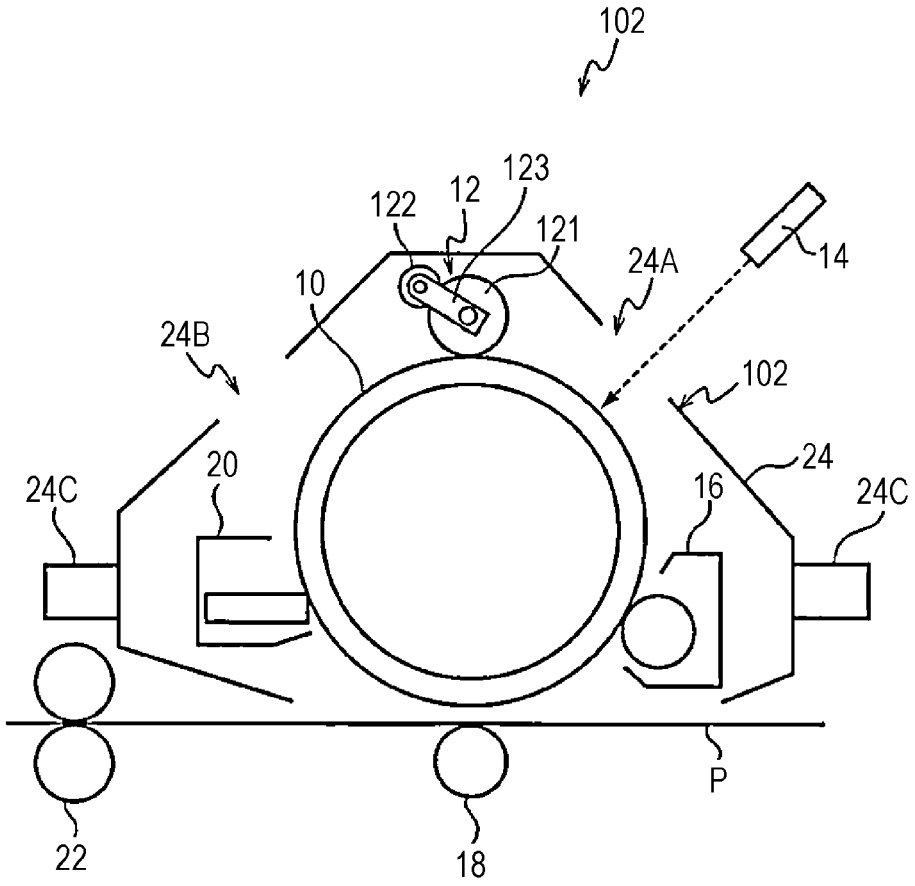
FIG. 5 is a schematic illustration of a process cartridge according to the exemplary embodiment.

As shown in FIG. 5, the process cartridge according to the exemplary embodiment is a process cartridge 102 including a housing 24 having an opening 24A for exposure, an opening 24B for erase exposure, and mounting rails 24C. In the image-forming apparatus 101 shown in FIG. 4, the housing 24 holds together the image carrier 10, the charging device 12 that charges the image carrier 10, the developing device 16 that develops a latent image formed by the exposure device 14 with a toner to form a toner image, and the cleaning device 20 that removes residual toner from the surface of the image carrier 10 after transfer. The process cartridge 102 is detachably attached to the image-forming apparatus 101 shown in FIG. 4.

EXAMPLES

The present disclosure will hereinafter be described in more detail with reference to the following examples, although these examples are not intended to limit the disclosure. Parts are by mass unless otherwise specified.

Fabrication of Charging Member (Hereinafter "Charging Roller")

Charging Roller A

A mixture of the following ingredients is kneaded on an open-roll mill and is applied to the surface of a conductive substrate formed of SUS416 and having a diameter of 6 mm to form a cylindrical coating having a thickness of 1.5 mm. The substrate is placed in a cylindrical mold having an inner diameter of 18.0 mm, and the coating is vulcanized at 170° C. for 30 minutes. After the substrate is removed from the mold, the coating is polished to obtain a cylindrical foamed elastic layer.

Polishing is performed with an LEO-600FS available from Minakuchi Machinery Works Ltd. under the following conditions: number of rotations of workpiece=200 rpm, and number of rotations of grindstone=2,300 rpm.

Ingredients for Foamed Elastic Layer

- Rubber material (epichlorohydrin-ethylene oxide-allyl glycidyl ether copolymer rubber, GECHRON 3106 available from Zeon Corporation): 100 parts by mass
- Conductor (carbon black, ASAHI THERMAL available from Asahi Carbon Co., Ltd.): 25 parts by mass
- Conductor (KETJENBLACK EC available from Lion Specialty Chemicals Co., Ltd.): 8 parts by mass
- Ionic conductor (lithium perchlorate): 1 part by mass
- Vulcanizing agent (200 mesh sulfur available from Tsurumi Chemical Industry Co., Ltd.): 1 part by mass
- Vulcanization accelerator (NOCCELER DM available from Ouchi Shinko Chemical Industrial Co., Ltd.): 2.0 parts by mass
- Vulcanization accelerator (NOCCELER TT available from Ouchi Shinko Chemical Industrial Co., Ltd.): 0.5 parts by mass Next, a mixture of the following ingredients is dispersed in a bead mill to obtain Dispersion A. Dispersion A is diluted with methanol to prepare a coating solution having a viscosity of 0.04 Pa·s. The coating solution is applied to the surface of the foamed elastic layer by dip coating to impregnate the bubbles in the surface portion of the foamed elastic layer with the coating solution, following by heat drying at 140° C. for 15 minutes to form a surface layer. The resulting conductive roller is used as a charging roller.

Ingredients for Surface Layer

- Polymer material (nylon copolymer, AMILAN CM8000 available from Toray Industries, Inc.): 100 parts by mass
- Conductor (antimony-doped tin oxide, SN-100P available from Ishihara Sangyo Kaisha, Ltd.): 30 parts by mass
- Filler (polyamide resin particles, ORGASOL 2001 D NAT 1 available from Arkema Inc.): 20 parts by mass
- Solvent (methanol): 500 parts by mass
- Solvent (butanol): 240 parts by mass Charging Roller A-1

Charging Roller A-1 is fabricated in the same manner as Charging Roller A except that the thickness of the foamed elastic layer is adjusted so that the outer diameter is as shown in Table 1.

Charging Roller B

Charging Roller B is fabricated in the same manner as Charging Roller A except that the filler is used in an amount of 15 parts by mass.

Charging Roller C

Charging Roller C is fabricated in the same manner as Charging Roller A except that the filler is used in an amount of 25 parts by mass.

Charging Roller D

Charging Roller D is fabricated in the same manner as Charging Roller A except that the filler is used in an amount of 27 parts by mass.

Charging Roller E

Charging Roller E is fabricated in the same manner as Charging Roller A except that the filler is used in an amount of 12 parts by mass.

Fabrication of Cleaning Member (Hereinafter "Cleaning Roller")

Fabrication of Cleaning Roller A

A urethane foam (available under the trade name EP-70 from Inoac Corporation) having an average cell size of 150 μm and containing 167 foam cells per 25 mm is cut to a size of 15 mm×15 mm×350 mm. A through-hole is formed in the center of the urethane foam. A core having an adhesive applied thereto (outer diameter of core=6 mm, length of core=343 mm, outer diameter of portions to be supported by bearings at both ends of core in axial direction=4 mm, length of portions to be supported by bearings at both ends of core in axial direction=6 mm) is inserted into the through-hole to bond the urethane foam to the core, following by polishing the outer surface to obtain Cleaning Roller A. The elastic layer has a length of 333 mm in the axial direction and an outer diameter of 10 mm.

Cleaning Roller A-1

Cleaning Roller A-1 is fabricated in the same manner as Cleaning Roller A except that the outer diameter is 9 mm.

Cleaning Roller B

Cleaning Roller B is fabricated in the same manner as Cleaning Roller A except that a urethane foam having an average cell size of 100 μm and containing 250 foam cells per 25 mm is used.

Cleaning Roller C

Cleaning Roller C is fabricated in the same manner as Cleaning Roller A except that a urethane foam having an average cell size of 200 μm and containing 125 foam cells per 25 mm is used.

Cleaning Roller D

Cleaning Roller D is fabricated in the same manner as Cleaning Roller A except that a urethane foam having an average cell size of 250 μm and containing 100 foam cells per 25 mm is used.

Cleaning Roller D-1

Cleaning Roller D-1 is fabricated in the same manner as Cleaning Roller D except that the outer diameter is 8 mm.

Cleaning Roller E

Cleaning Roller E is fabricated in the same manner as Cleaning Roller A except that a urethane foam having an average cell size of 240 μm and containing 104 foam cells per 25 mm is used.

Cleaning Roller F

Cleaning Roller F is fabricated in the same manner as Cleaning Roller A except that a urethane foam having an average cell size of 300 μm and containing 83 foam cells per 25 mm is used.

Cleaning Roller G

Cleaning Roller G is fabricated in the same manner as Cleaning Roller A except that a urethane foam having an average cell size of 350 μm and containing 71 foam cells per 25 mm is used.

Examples 1 to 5 and Comparative Examples 1 to 6

Each combination of a charging roller and a cleaning roller shown in Table 1 is incorporated into a charging device of an image-forming apparatus (DocuCentre-VI C7771 available from Fuji Xerox Co., Ltd.). Thus, a charging device of each example is obtained.

Evaluation

Various Properties of Charging Rollers and Cleaning Rollers

The various properties of the fabricated charging rollers and cleaning rollers are measured by the methods described above. The results are shown in Table 1.

Streak-Like Image Defect Evaluation

The image-forming apparatus (DocuCentre-VI C7771 available from Fuji Xerox Co., Ltd.) including the charging device of each example is used as an apparatus for evaluation to print a 50% halftone image on 100,000 sheets of A4 paper. The image printed on the 100,000th sheet is observed and rated on the following rating scale:

G1: minor color or white streaks that can be found as viewed carefully

G2: color or white streaks at a level between G1 and G3

G3: acceptable color or white streaks

G4: color or white streaks at a level between G3 and G5

G5: unacceptable color or white streaks

The details of each example are listed in Table 1.

The details of the abbreviations in the table are as follows:

SFE1: surface free energy of surface of charging roller (i.e., surface layer)

SFE2: surface free energy of surface of cleaning roller (i.e., foamed elastic layer)

Surface roughness Rz

TABLE 1

| | Charging roller | | | | Cleaing roller | | | | | | Ratio of outer diameter of charging member to outer diameter of cleaning member | Evaluation |
|---|---|---|---|---|---|---|---|---|---|---|---|---|
| | Type | SFE1 (mN/m) | Rz (μm) | Outer diameter (mm) | Type | SFE2 (mN/m) | Average cell size (μm) | Number of foam cells (cells per 25 mm) | Outer diameter (mm) | SFE2-SFE1 (mN/m) | | Streak-like image defects |
| Example 1 | A | 120 | 20 | 12 | A | 180 | 150 | 167 | 10 | 60 | 1.20 | G1 |
| Example 2 | A-1 | 120 | 20 | 11 | A-1 | 180 | 150 | 167 | 9 | 60 | 1.22 | G0 |
| Example 3 | B | 90 | 15 | 12 | B | 210 | 100 | 250 | 10 | 120 | 1.20 | G0 |
| Example 4 | B | 90 | 15 | 12 | C | 150 | 200 | 125 | 10 | 60 | 1.20 | G1 |
| Example 5 | C | 150 | 25 | 12 | B | 210 | 100 | 250 | 10 | 30 | 1.20 | G1 |
| Comparative Example 1 | A | 120 | 20 | 12 | D | 90 | 250 | 100 | 10 | −30 | 1.20 | G3 |
| Comparative Example 2 | A | 120 | 20 | 12 | D-1 | 90 | 250 | 100 | 8 | −30 | 1.50 | G4 |
| Comparative Example 3 | D | 160 | 27 | 12 | C | 150 | 200 | 125 | 10 | −10 | 1.20 | G3 |
| Comparative Example 4 | D | 160 | 27 | 12 | E | 100 | 240 | 104 | 10 | −60 | 1.20 | G4 |
| Comparative Example 5 | E | 80 | 12 | 12 | F | 50 | 300 | 83 | 10 | −20 | 1.20 | G3 |
| Comparative Example 6 | E | 80 | 12 | 12 | G | 20 | 350 | 71 | 10 | −60 | 1.20 | G4 |

The above results show that the charging devices of the Examples have a reduced tendency to cause streak-like image defects as compared to the charging devices of the Comparative Examples.

This demonstrates that the adhesion and accumulation of oil components on the surfaces of the charging rollers (in other words, the members to be cleaned) of the charging devices of the Examples are reduced as compared to the charging devices of the Comparative Examples.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A charging device comprising:

a charging member that includes a conductive elastic layer and a conductive surface layer disposed on an outer circumferential surface of the conductive elastic layer; and a cleaning member that includes a support and a foamed elastic layer disposed on an outer circumferential surface of the support and having a higher surface free energy than the conductive surface layer of the charging member and that rotates in contact with the conductive surface layer of the charging member, wherein the conductive surface layer of the charging member has a surface free energy of 90 mN/m or more and 150 mN/m or less, and the foamed elastic layer of the cleaning member has a surface free energy of more than 150 mN/m and 210 mN/m or less.

2. The charging device according to claim 1, wherein the conductive surface layer of the charging member has a surface free energy of 110 mN/m or more and 130 mN/m or less, and the foamed elastic layer of the cleaning member has a surface free energy of more than 170 mN/m and 190 mN/m or less.

3. The charging device according to claim 1, wherein a difference in surface free energy between the conductive surface layer of the charging member and the foamed elastic layer of the cleaning member is 30 mN/m or more and 90 mN/m or less.

4. The charging device according to claim 3, wherein the difference in surface free energy between the conductive surface layer of the charging member and the foamed elastic layer of the cleaning member is 50 mN/m or more and 70 mN/m or less.

5. The charging device according to claim 1, wherein the conductive surface layer of the charging member has a surface roughness Rz of 15 μm or more and 30 μm or less.

6. The charging device according to claim 1, wherein the foamed elastic layer of the cleaning member has an average cell size of 100 μm or more and 200 μm or less.

7. The charging device according to claim 1, wherein the cleaning member has a larger outer diameter than the charging member.

8. The charging device according to claim 1, wherein a ratio of an outer diameter of the charging member to an outer diameter of the cleaning member (outer diameter of charging member/outer diameter of cleaning member) is 8/12 or more and 14/6 or less.

9. The charging device according to claim 8, wherein the ratio of the outer diameter of the charging member to the outer diameter of the cleaning member (outer diameter of charging member/outer diameter of cleaning member) is 10/10 or more and 12/8 or less.

10. A process cartridge attachable to and detachable from an image-forming apparatus, the process cartridge comprising:

an image carrier; and a charging device that includes a charging member disposed in contact with the image carrier and a cleaning member and that charges the image carrier, the charging device comprising the charging device according to claim 1.

11. An image-forming apparatus comprising:

an image carrier;

a charging device that includes a charging member disposed in contact with the image carrier and a cleaning member and that charges the image carrier, the charging device comprising the charging device according to claim 1;

a latent-image forming device that forms a latent image on a charged surface of the image carrier;

a developing device that develops the latent image formed on the surface of the image carrier with a toner to form a toner image; and a transfer device that transfers the toner image formed on the surface of the image carrier to a recording medium.

* * * * *